US009632468B2

(12) United States Patent
Ueda et al.

(10) Patent No.: US 9,632,468 B2
(45) Date of Patent: Apr. 25, 2017

(54) IMAGE FORMING APPARATUS INCLUDING A MAIN POWER SWITCH

(71) Applicants: Yuta Ueda, Tokyo (JP); Yuki Sato, Kanagawa (JP); Mami Akiyama, Kanagawa (JP); Shiro Akama, Tokyo (JP); Hiroki Ishimitsu, Kanagawa (JP); Sakie Higuchi, Kanagawa (JP)

(72) Inventors: Yuta Ueda, Tokyo (JP); Yuki Sato, Kanagawa (JP); Mami Akiyama, Kanagawa (JP); Shiro Akama, Tokyo (JP); Hiroki Ishimitsu, Kanagawa (JP); Sakie Higuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/976,382

(22) Filed: Dec. 21, 2015

(65) Prior Publication Data

US 2016/0187825 A1 Jun. 30, 2016

(30) Foreign Application Priority Data

Dec. 24, 2014 (JP) ..... 2014-260774

(51) Int. Cl.
*G03G 15/00* (2006.01)
*G03G 21/16* (2006.01)

(52) U.S. Cl.
CPC ..... *G03G 15/5016* (2013.01); *G03G 15/80* (2013.01); *G03G 21/1633* (2013.01)

(58) Field of Classification Search
CPC ..... G03G 15/5016
USPC ..... 399/88
See application file for complete search history.

(56) References Cited

U.S. PATENT DOCUMENTS 8,626,019 B2 * 1/2014 Amemiya ..... G03G 15/5016 399/88
2002/0056630 A1 * 5/2002 Horiguchi ..... H01H 9/287 200/333

FOREIGN PATENT DOCUMENTS

JP 2007-272178 10/2007
JP 2009-058668 3/2009

OTHER PUBLICATIONS

HP Laser Jet Pro 400 MFP . . . (Manual for 400mfd 435dn); publication date Oct. 2014 (p. 4 of 6) sp4ts.old_509624 (pages from the HP Laser Jet Pro 400 manual); publication date Oct. 2014 (p. 4 or 6).*

* cited by examiner

*Primary Examiner* — Quana M Grainger
(74) *Attorney, Agent, or Firm* — Harness, Dickey & Pierce, P.L.C.

(57) ABSTRACT

An arrangement structure of a main power switch includes an apparatus body, the main power switch, and a movable member. The apparatus body has a dead space on a front side. The main power switch is disposed in the dead space. The movable member is disposed in the apparatus body to cover the main power switch. The movable member is drawable from the apparatus body in a horizontal direction. The movable member includes an opening opposed to the main power switch, to expose the main power switch to outside.

8 Claims, 4 Drawing Sheets

IMAGE FORMING APPARATUS INCLUDING A MAIN POWER SWITCH

CROSS-REFERENCE TO RELATED APPLICATION

This patent application is based on and claims priority pursuant to 35 U.S.C. §119(a) to Japanese Patent Application No. 2014-260774, filed on Dec. 24, 2014, in the Japan Patent Office, the entire disclosure of which is hereby incorporated by reference herein.

BACKGROUND

Technical Field

Exemplary aspects of the present disclosure generally relate to an arrangement structure of a main power switch of an apparatus, and more specifically to an arrangement structure of a main power switch of an apparatus, such as an image forming apparatus, and the image forming apparatus incorporating the structure.

Related Art

Recent apparatuses, such as an image forming apparatus, include a main power switch to turn on and off the power of the entire apparatus and a power save switch to turn on and off the power of an image formation engine, and the like while supplying power to a controller and the like. In such an imaging forming apparatus, there is a case that the main power switch is disposed on the front side of an apparatus body from the viewpoint of visibility and operability. In many cases, the main power switch is disposed close to the power save switch.

In recent years, a push switch is widely used as the main power switch of the image forming apparatus. For example, an image forming apparatus includes the push switch on the upper right of the front cover.

SUMMARY

In an aspect of this disclosure, there is provided an arrangement structure of a main power switch including an apparatus body, the main power switch, and a movable member. The apparatus body has a dead space on a front side. The main power switch is disposed in the dead space. The movable member is disposed in the apparatus body to cover the main power switch. The movable member is drawable from the apparatus body in a horizontal direction. The movable member includes an opening opposed to the main power switch, to expose the main power switch to outside.

In another aspect of this disclosure, there is provided an image forming apparatus including an apparatus body, a sheet feed tray, and a main power switch on the apparatus body. The sheet feed tray has an exterior member and is drawable from the apparatus body in a horizontal direction. The exterior member of the sheet feed tray includes an opening opposed to the main power switch. The opening exposes the main power switch to outside.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 2A:
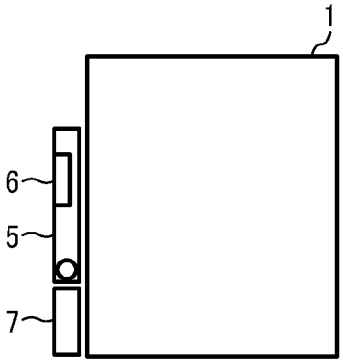
Figure 2B:
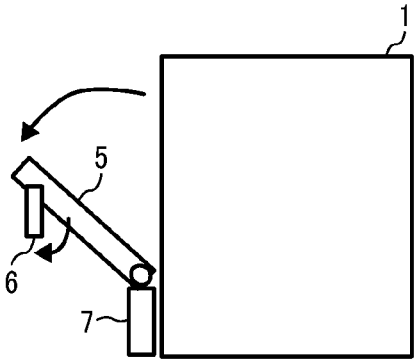
Figure 3B:
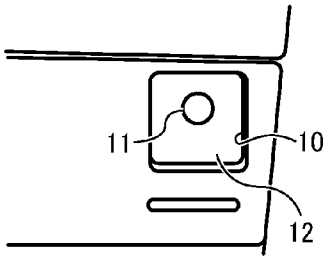
Figure 3C:
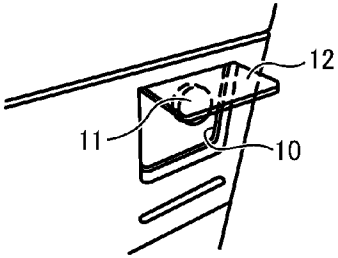
Figure 3D:
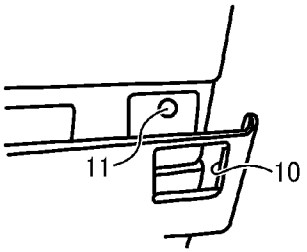
Figure 3A:
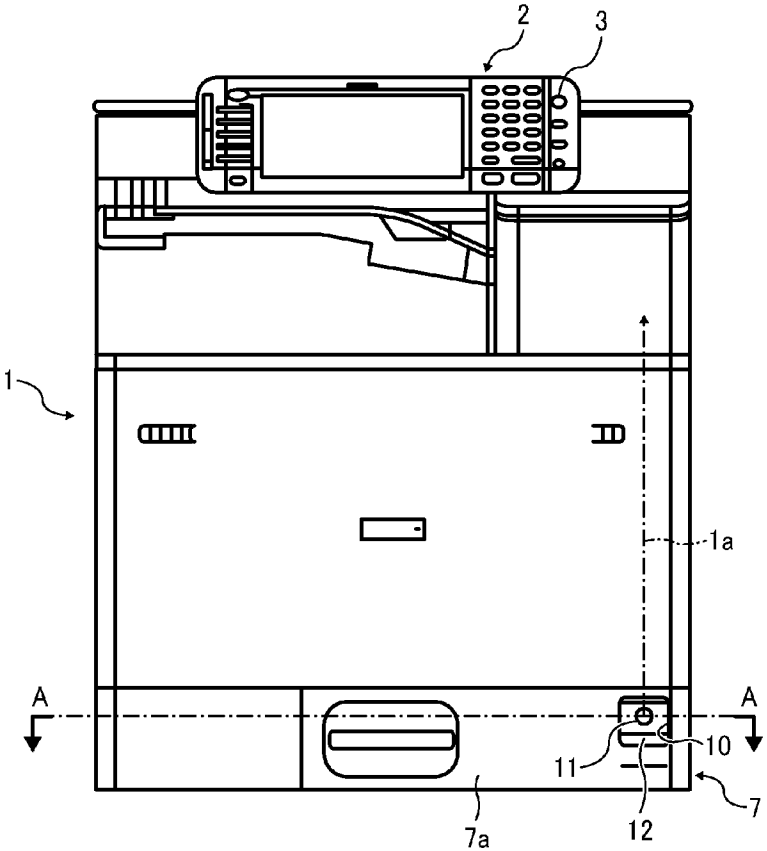
Figure 4:
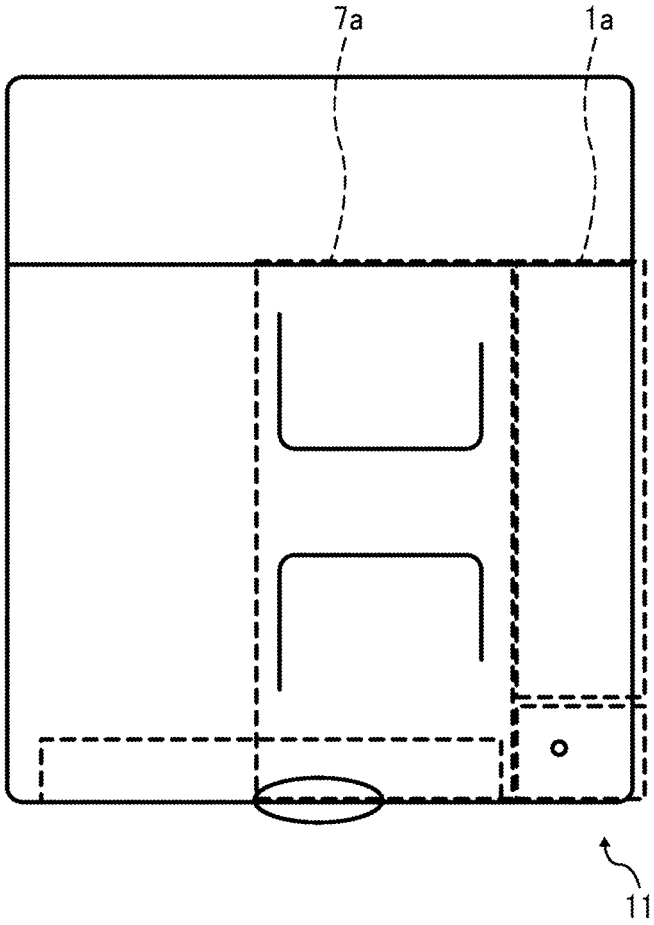

Each of FIGS. 2A and 2B is a side view of the image forming apparatus including the main power switch on the exterior surface of the apparatus or on the inner side of the front cover as an example of the present disclosure;

FIG. 3A is a front view of the image forming apparatus according to one example of the present embodiment;

FIG. 3B is a partially enlarged view of the image forming apparatus according to one example of the present embodiment;

FIG. 3C is a partially enlarged perspective view of the image forming apparatus with a transparent cover open according to one example of the present disclosure; and FIG. 3D is a partially enlarged perspective view of the image forming apparatus with the front cover open to expose the main power switch to outside;

FIG. 4 is a section view of FIG. 3A along the line A-A; and

Figure 5:
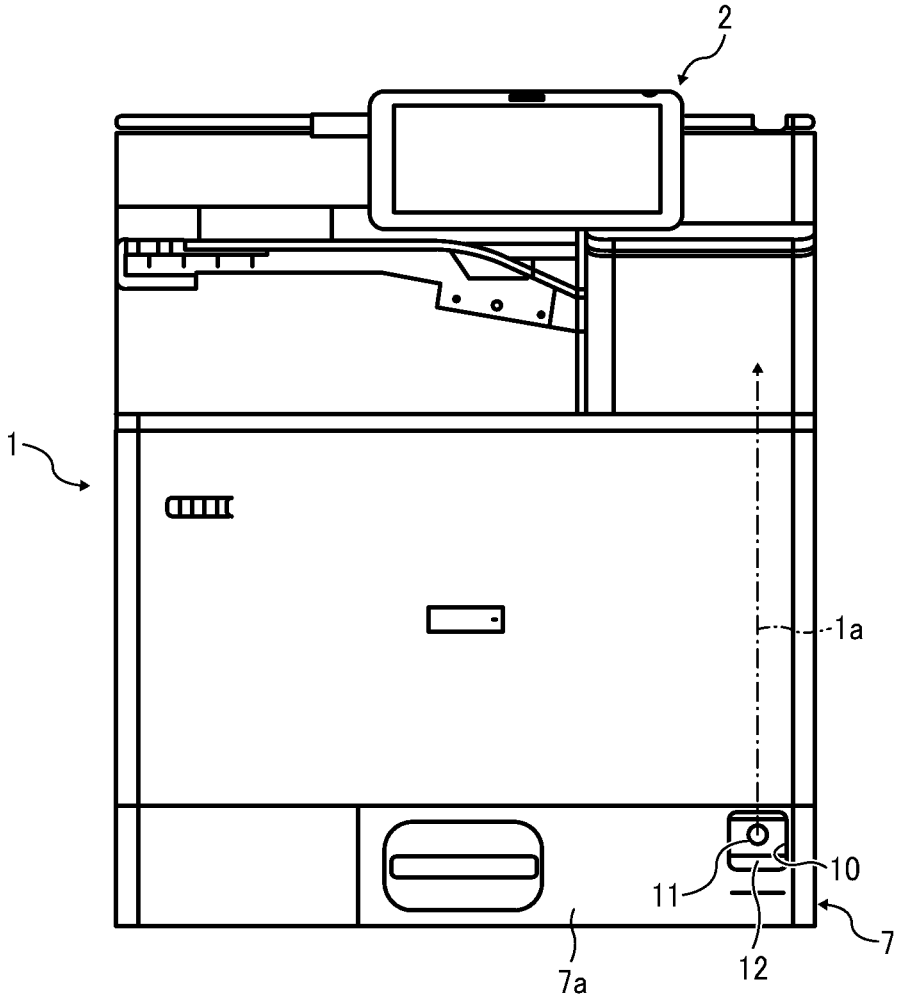

FIG. 5 is a front view of the image forming apparatus according to another embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 1:
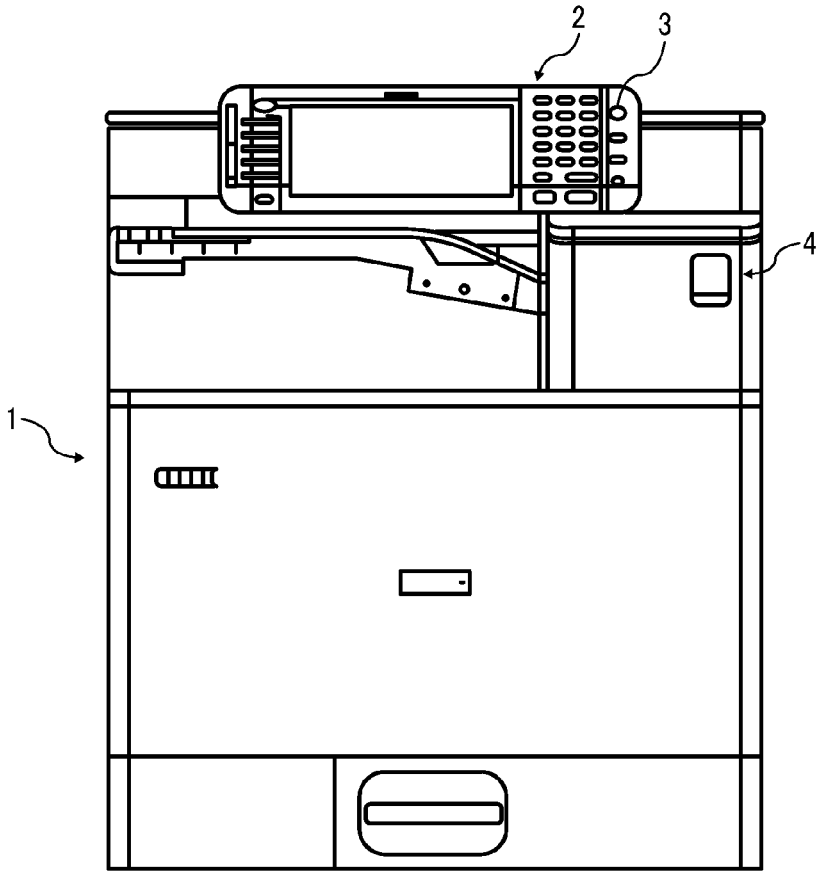
FIG. 1 is a front view of an image forming apparatus including an arrangement structure of a main power switch of an apparatus as a typical example of the present disclosure.

FIG. 1 is a front view of an image forming apparatus having an arrangement structure of a main power switch according to a comparative example. The image forming apparatus of FIG. 1 includes an apparatus body 1, a control panel 2, a power save switch 3, and a main power switch 4 with a cover thereof. In the comparative example of FIG. 1, the main power switch 4 is disposed adjacent to the power save switch 3 on the front side of the apparatus body 1. In the image forming apparatus with such an arrangement structure, a user might erroneously press the main power switch instead of the power save switch.

Alternatively, when an image forming apparatus includes a push switch on, e.g., the upper right of the front cover, an unaccustomed user may have difficulty in distinguishing the push switch from the power save switch on the control panel. Such a user might erroneously press the main power switch although the user intends to press the power save switch, to change the state of the apparatus to an energy save mode or return it from the energy save mode.

Erroneously turning off the main power switch wastes time in turning on the main power switch to reactivate the shut-down apparatus. Further, turning off the main power during printing interferes with the image forming process, which may cause troubles after the apparatus reactivates.

Alternatively, when the image forming apparatus includes the main power switch on the exterior surface of the apparatus or on the inner side of the front cover, visibility is degraded. However, as illustrated in FIGS. 2A and 2B, the image forming apparatus includes the main power switch on the exterior side of the front cover 5 of the apparatus body 1, having an openable cover 6 which is usually transparent or semitransparent. In such a case, visibility is enhanced. The image forming apparatus of FIGS. 2A and 2B may, however, possibly cause the cover 6 to break because the cover 6 unintentionally opens and closes, simultaneously with the opening and closing of the front cover 5. Each of FIGS. 2A and 2B illustrates a sheet feed tray 7.

By contrast, as described below, according to at least one embodiment of the present disclosure, an image forming apparatus without an increase in the size and cost allows a user to easily distinguish a main power switch from a power save switch. This prevents a degradation in operability due to the user's erroneous pressing of the main power switch instead of the power save switch.

With reference to the drawings, a description is provided of an image forming apparatus according to an embodiment of the present disclosure.

Exemplary aspects of the present disclosure generally relate to an arrangement structure of a main power switch of an apparatus, and more specifically to an arrangement structure of a main power switch of an apparatus, such as an image forming apparatus, and the image forming apparatus incorporating the structure. The arrangement structure of the present disclosure includes an apparatus body, a main power switch, a movable member, e.g., a sheet feed tray, and an opening. The apparatus body includes dead space on the front surface thereof. The main power switch is disposed in the dead space. The movable member is movably disposed in the apparatus body, to cover the main power switch. The movable member is drawable from the apparatus body in a horizontal direction. The opening is formed on the sheet feed tray, opposed to the main power switch, to expose the main power switch to outside.

Embodiment 1

FIG. 3A is a front view of the image forming apparatus according to one example of the present embodiment. FIG. 3B is a partially enlarged view of the image forming apparatus according to one example of the present embodiment. FIG. 3C is a partially enlarged perspective view of the image forming apparatus with a transparent cover open according to one example of the present disclosure. FIG. 3D is a partially enlarged perspective view of the image forming apparatus with the front cover open to expose the main power switch to the outside. FIG. 4 is a section view of FIG. 3A along the line A-A. It should be noted that the same reference signs are respectively given to an apparatus, elements, and parts, which are the same as those of the example described above.

The image forming apparatus of FIG. 3A includes a sheet feed tray 7, which is horizontally drawn from an apparatus body 1. The sheet feed tray 7 includes an exterior member, which is a cover 7*a* serving as a drawer handle, with an opening 10 at the right lower end portion of the sheet feed tray 7 in FIG. 3A.

The apparatus body 1 includes a main power switch 11 at a position corresponding to the position of the sheet feed tray 7 at the right lower end of FIG. 3A. In FIG. 3A as well, the reference number 2 refers to a control panel, and the reference number 3 refers to a power save switch. It should be noted that the main power switch to be described later is a pushing switch, and the other switches, except the main power switch, is the power save switch 3 are touch panel operation switches.

The main power switch 11 is opposed to the opening 10 with the sheet feed tray 7 housed within the apparatus body 1 with the closed cover 7*a*. The main power switch 11 is disposed below a longitudinal sheet conveyance path 1*a* serving as a sheet conveyance path within the apparatus body 1. Assuming that the sheet feed tray 7 also includes a sheet conveyance path, the main power switch 11 is disposed near or on the front side of the sheet conveyance path. For example, the main power switch is disposed below the sheet feed tray 7 of the apparatus body 1 as well as on the front side of the apparatus body 1. That is, the main power switch 11 is disposed adjacent to the longitudinal sheet conveyance path 1*a* within the apparatus body 1. In other words, the main power switch 11 is disposed in the dead space formed by the sheet feed tray 7 and the longitudinal sheet conveyance path 1*a*.

The cover 7*a* of the sheet feed tray 7 includes a transparent cover 12 opposed to the main power switch 11, the transparent cover 12 allowing a user to view the main power switch 11 from the outside. The cover 7*a* horizontally supports an upper edge of the transparent cover 12. Thus, the transparent cover 12 vertically pivots on the upper edge to open and close. In this case, the transparent cover 12 in a closed state is placed in parallel to the cover 7*a*. As the main power switch 11 has the transparent cover 12 on the front side thereof, a user is prevented from erroneously pressing the main power switch 11. In the present embodiment, the sheet feed tray 7 is drawable from the apparatus body in a horizontal direction, which prevents the transparent cover 12 from unintentionally opening and closing.

With such a configuration, the main power switch 11 is disposed apart from the power save switch 3 arranged on the control panel 2 on the upper portion of the apparatus body 1. Further, the main power switch 11 is disposed on the front side of the apparatus body 1. As a result, visibility of the main power switch 11 is obtained. Accordingly, erroneously pressing the main power switch 11, instead of the power save switch 3, is prevented. In addition, the main power switch 11 is disposed in the dead space formed by the sheet feed tray 7 and the longitudinal sheet conveyance path 1*a*, thereby making a good use of the dead space, which results in a reduction in the size of the apparatus. Further, as no sensors are employed, the size and cost is reduced.

Embodiment 2

FIG. 5 is a front view of the image forming apparatus according to another embodiment of the present disclosure.

In the present embodiment, substantially the entirety of an operation unit of a control panel 2 is formed by a liquid crystal panel 2*a* to display an image of a power save switch. With the same configuration as that of the first embodiment, the image forming apparatus having the control panel 2 according to the second embodiment also exhibits the same operation and effects as those of the first embodiment. A description is omitted, of the same parts as those of the image forming apparatus according to the first embodiment.

Although the embodiment of the present disclosure has been described above, the present disclosure is not limited to the foregoing embodiments, and a variety of modifications can naturally be made within the scope of the present disclosure.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an apparatus body;

a sheet feed tray in the apparatus body and having an exterior member, the sheet feed tray drawable from the apparatus body in a horizontal direction; and a main power switch on the apparatus body, wherein the exterior member of the sheet feed tray includes an opening opposed to the main power switch, configurable to expose the main power switch to outside, wherein the sheet feed tray includes a cover on a front side thereof to cover the main power switch on an inner side of the sheet feed tray in the apparatus body and adjacent to a sheet conveyance path within the apparatus body.

2. The image forming apparatus according to claim 1, further comprising an openable transparent cover on the opening.

3. The image forming apparatus according to claim 1, wherein the main power switch is on an inner side of the sheet feed tray in the apparatus body and adjacent to a sheet conveyance path within the apparatus body.

4. The image forming apparatus according to claim 1, further comprising a touch panel operation switch separately provided from the main power switch, wherein the main power switch is a push switch.

5. An image forming apparatus, comprising:

an apparatus body;

a sheet feed tray in the apparatus body and having an exterior member, the sheet feed tray drawable from the apparatus body in a horizontal direction;

a main power switch on the apparatus body;

wherein the exterior member of the sheet feed tray includes an opening opposed to the main power switch, configurable to expose the main power switch to outside; and an openable transparent cover on the opening, wherein the transparent cover is configured to move together with the sheet feed tray when the sheet feed tray is drawn from the apparatus body.

6. The image forming apparatus according to claim 5, wherein the main power switch is configured to be exposed to the outside when the sheet feed tray is drawn from the apparatus body.

7. The image forming apparatus according to claim 5, wherein the main power switch is on an inner side of the sheet feed tray in the apparatus body and adjacent to a sheet conveyance path within the apparatus body.

8. The image forming apparatus according to claim 5, further comprising a touch panel operation switch separately provided from the main power switch, wherein the main power switch is a push switch.

* * * * *